US006248048B1

(12) United States Patent
Zuckerman et al.

(10) Patent No.: US 6,248,048 B1
(45) **Date of Patent: *Jun. 19, 2001**

(54) PORTABLE EXERCISE APPARATUS

(76) Inventors: Robert Zuckerman, 350-1/2 Genesee Ave., Los Angeles, CA (US) 90036; Travis Burrell, 3520 Hughes Ave., #12, Los Angeles, CA (US) 90034

( * ) Notice: Subject to any disclaimer, the term of this patent is extended or adjusted under 35 U.S.C. 154(b) by 0 days.

This patent is subject to a terminal disclaimer.

(21) Appl. No.: 09/361,748

(22) Filed: Jul. 27, 1999

Related U.S. Application Data

(63) Continuation-in-part of application No. 09/132,345, filed on Aug. 12, 1998, which is a continuation-in-part of application No. 08/843,270, filed on Apr. 14, 1997, now abandoned.

(51) Int. Cl.[7] ..... A63B 26/00

(52) U.S. Cl. ..... 482/142; 482/148; 482/66; 482/141

(58) Field of Search ..... 482/66, 141–142, 482/148, 24; 135/66–7

(56) References Cited

U.S. PATENT DOCUMENTS

| | | |
|---|---|---|
| D. 265,575 | 7/1982 | Lunford . |
| 2,666,640 | 1/1954 | Jennings, Sr. . |
| 2,817,387 | 12/1957 | Blake . |
| 3,421,529 | 1/1969 | Vestal . |
| 3,540,724 | 11/1970 | Hunter . |
| 3,679,203 | 7/1972 | Grana . |
| 3,688,789 | 9/1972 | Bunch . |
| 3,945,389 | 3/1976 | Smith . |
| 4,232,863 | 11/1980 | Roach . |
| 4,456,248 | 6/1984 | Smith . |
| 4,518,002 | 5/1985 | Battiston, Sr. et al. . |
| 4,927,138 | 5/1990 | Ferrari . |
| 4,995,412 | 2/1991 | Hirn et al. . |
| 5,096,187 | 3/1992 | Marples . |
| 5,106,079 | 4/1992 | Escobedo et al. . |
| 5,255,696 | 10/1993 | Leonard . |
| 5,275,187 | 1/1994 | Davis . |
| 5,302,164 | 4/1994 | Austin . |
| 5,403,258 | 4/1995 | Hill . |
| 5,579,793 | 12/1996 | Gajewski et al. . |

*Primary Examiner*—Jerome W. Donnelly
*Assistant Examiner*—Lori Baker Amerson
(74) *Attorney, Agent, or Firm*—Lyon & Lyon LLP

(57) ABSTRACT

A portable folding exercise apparatus has left and right side frames pivotably attached to a cross brace. Handgrips on the side frames are useful for performing traditional dips and knee raises, with the apparatus in an upright position. A cross brace has a pair of parallel handgrips useful for performing close parallel regular push-ups, tricep dips, abdominal crunches, arm curls, hammer curls, and shoulder presses. The exercise apparatus is preferably formed of welded steel tubing, and is sufficiently rigid to resist excessive bending or deflection during use, even under extreme loads generated by heavy users. Quick release pins lock the side frames into an open position for use and may lock the side frames into a closed position for transport or storage.

6 Claims, 18 Drawing Sheets

Fig. 4
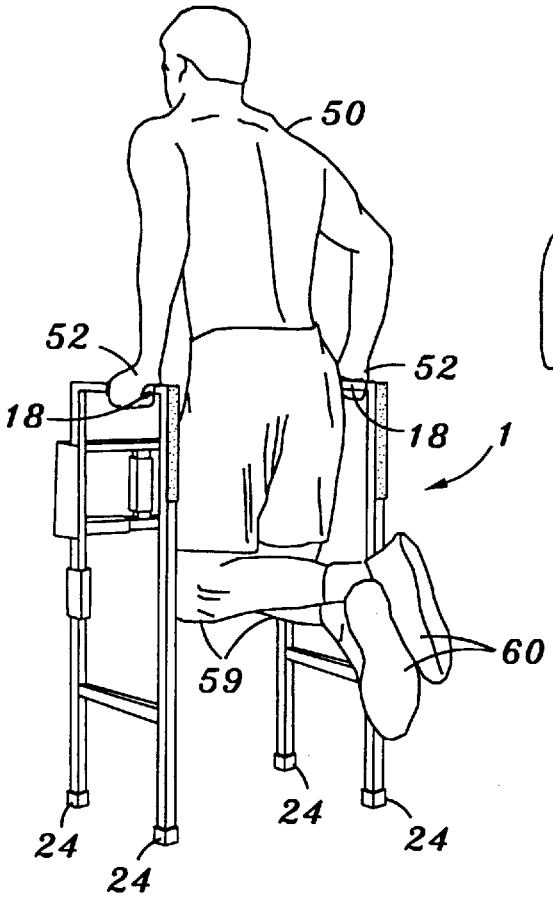
Fig. 5
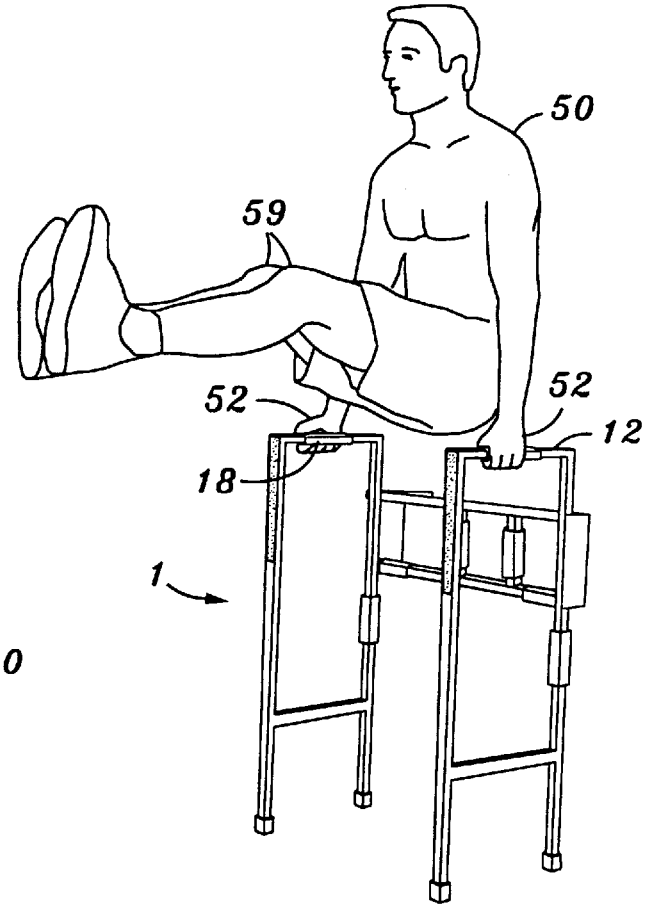
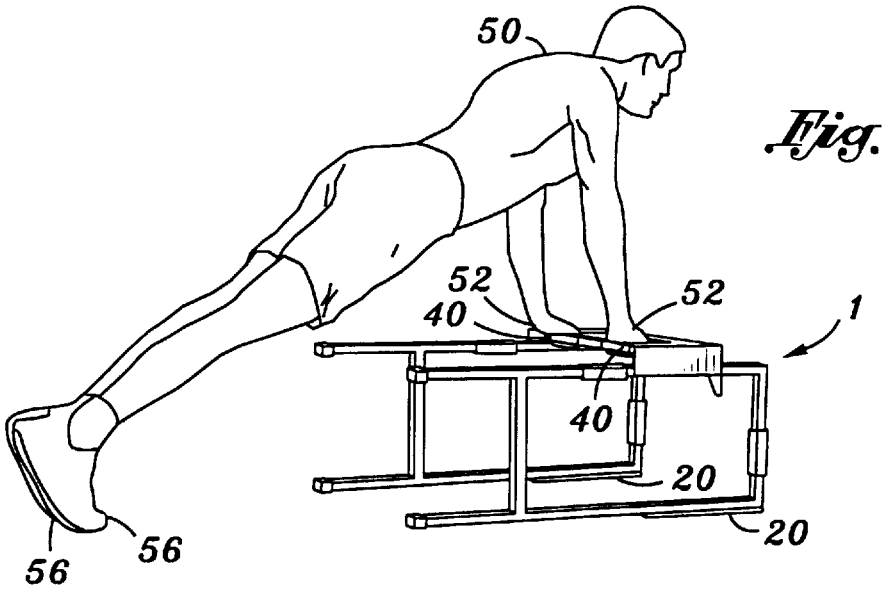
Fig. 6

Fig. 5A
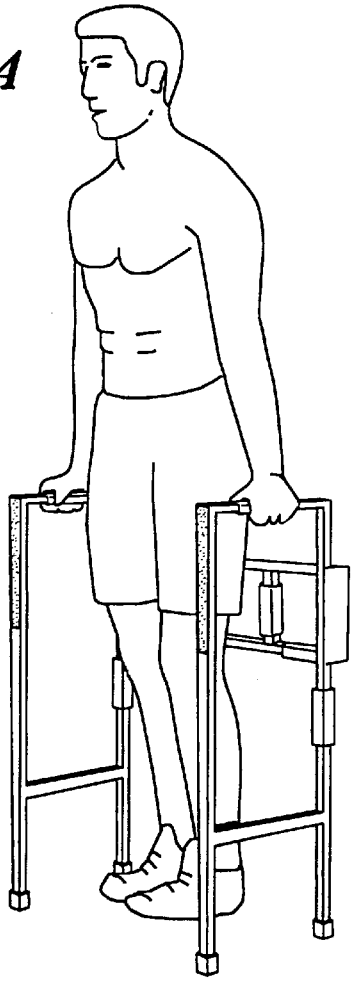
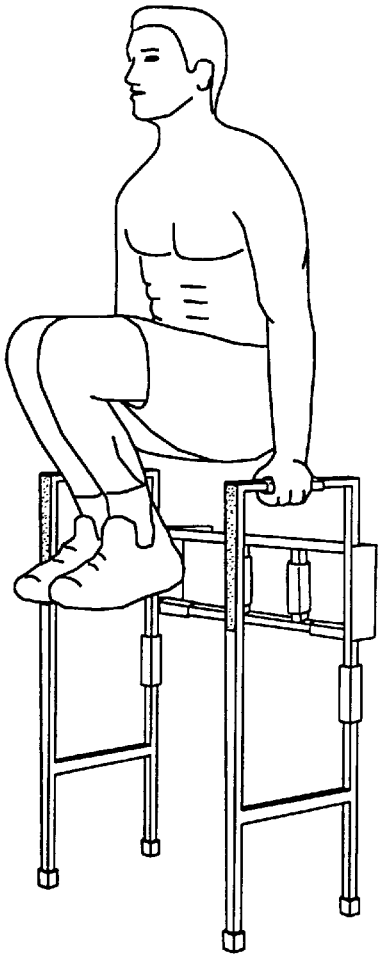
Fig. 5B

Fig. 10B
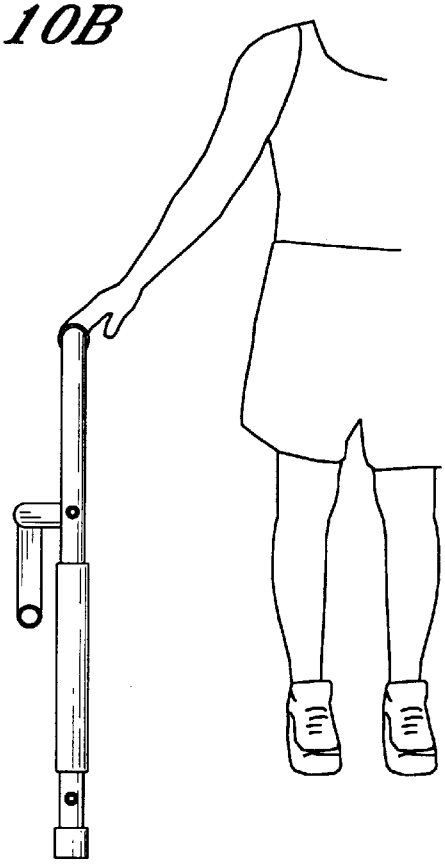
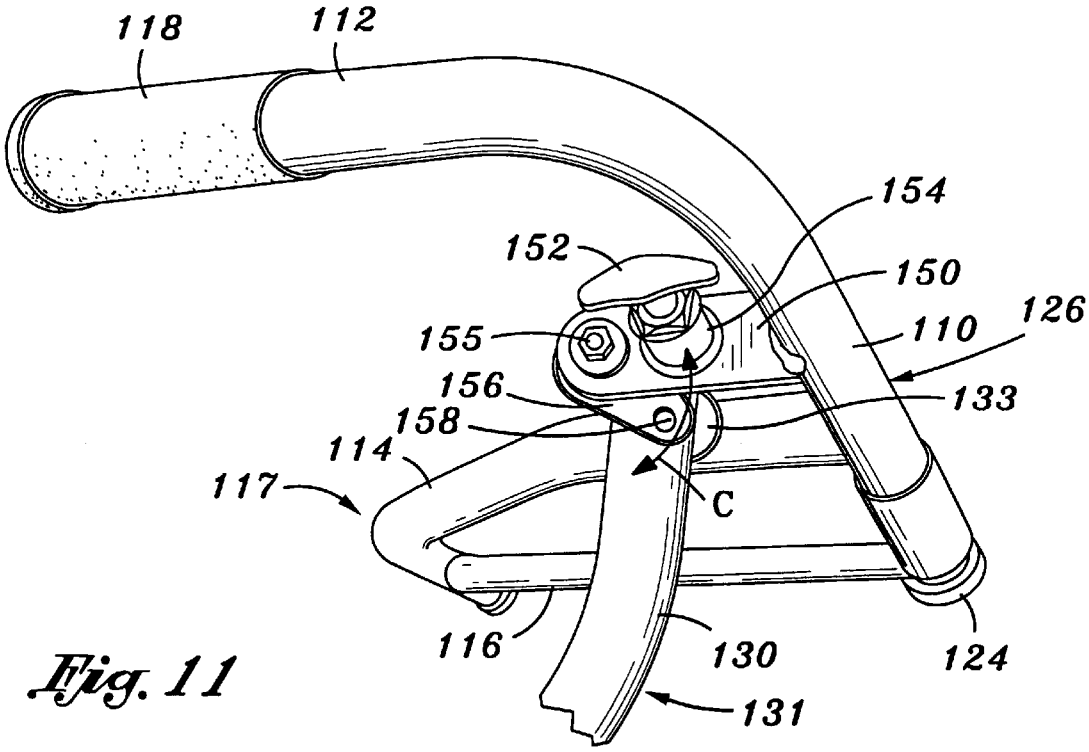
Fig. 11

Fig. 24
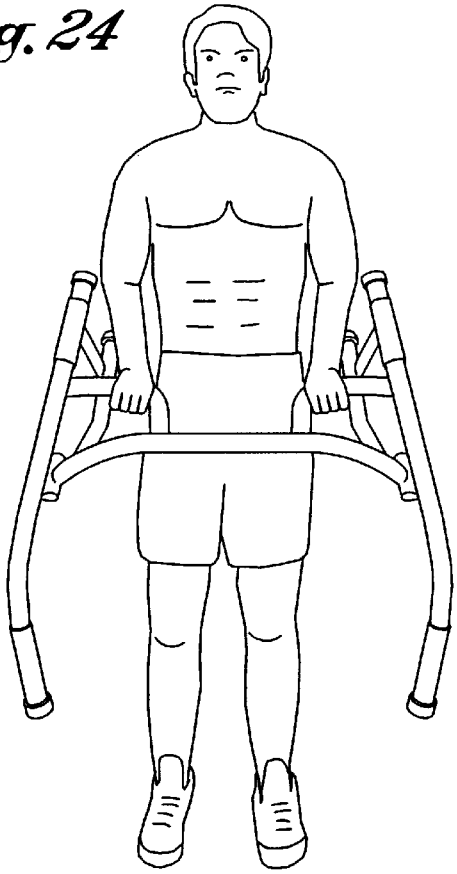
Fig. 25
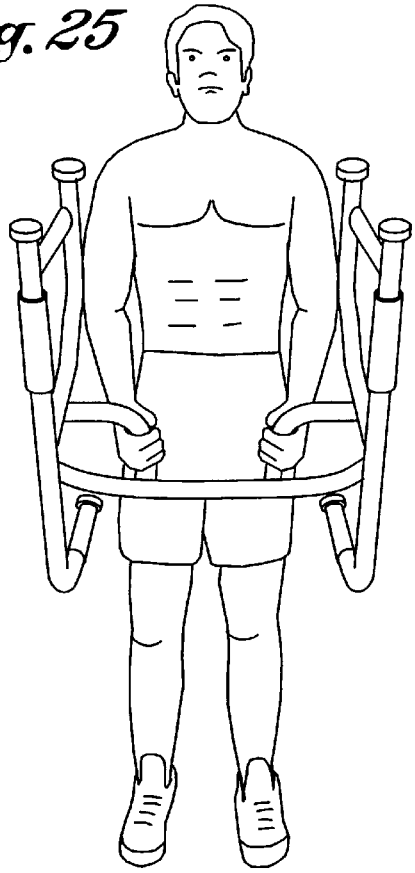
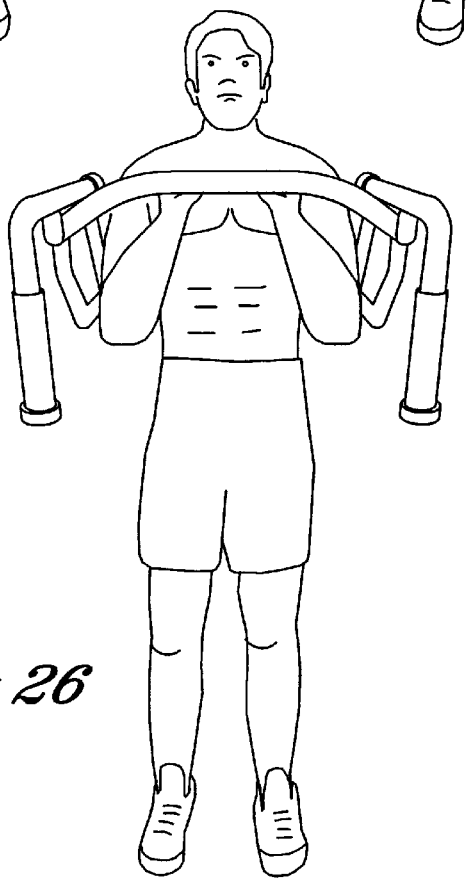
Fig. 26

PORTABLE EXERCISE APPARATUS

This application is a continuation-in-part of U.S. patent application Ser. No. 09/132,345, filed Aug. 12, 1998, which is a continuation-in-part of U.S. patent application Ser. No. 08/843,270, filed Apr. 14, 1997, and now abandoned.

FIELD OF THE INVENTION

This invention relates generally to exercise devices, and more particularly to a portable, foldable isometric exercise apparatus that is useful in carrying out a wide variety of upper-body and abdominal exercises.

BACKGROUND OF THE INVENTION

Recent studies and articles in the popular media have reported that regular exercise is beneficial to health and longevity. As a result, membership gyms have become very popular among those seeking an exercise regimen. However, it is often difficult to maintain a regular exercise routine when visits to a gym are inconvenient or impossible, due to, for example, traveling or working. Thus, it is desired to be able to exercise in the convenience of one's home, office, temporary workplace, hotel room, etc., using a lightweight and portable exercise apparatus that can be stored and transported readily.

One of the best forms of exercise to improve muscle tone and strength, as well as to increase overall fitness, is isometric weight training, in which the exerciser may use his or her own body weight as resistance against muscular movement. For example, a number of common upper-body and abdominal exercises utilize isometric resistance, including dips and push-ups for upper-body muscular development, and leg or knee raises for abdominal muscles.

Isometric exercise apparatus are generally advantageous in that they do not necessitate the implementation of moving parts or supplemental weights for their utility, or a second person to spot the user. However, isometric exercise apparatus are nevertheless typically quite heavy and bulky, and are usually not portable. In addition, these apparatus are commonly incorporated into expensive multi-station gyms, which occupy a substantial area of floor space. Accordingly, such exercise devices are often ill suited to home or office use because of their bulk and their non-portability.

Prior attempts to provide portable exercise apparatus have largely failed to solve the aforementioned problems, due to a variety of reasons. Such known apparatus have often been highly specialized and limited to one orientation, thereby permitting the exercise of only a single discrete portion of an individual's anatomy. For example, apparatus consisting of fixed, high-mounted horizontal parallel bars allow the user to perform traditional full-body dips and leg or knee raises, but do not facilitate other varieties of dip exercises which isolate certain muscle groups (such as "tricep dips," where a user performs dips with his/her arms behind the back, while maintaining the back of his/her heels on the floor) or multiple variations of push-ups of any kind. Another prior art example is the simple push-up bar which does not allow the user to perform full-body dips or knee raises to exercise his/her abdominal muscles. In addition, the portability of some prior art apparatus has required the assembly/disassembly of numerous component parts, use of tools making the devices difficult and time-consuming to use. Further, many of the portable exercise devices in the prior art have lacked sufficient stability or sturdiness.

SUMMARY OF THE INVENTION

In view of the foregoing disadvantages of prior art exercise equipment, the present invention provides a compact, lightweight exercise apparatus preferably utilizing a pair of side frames, each of which is pivotally connected to a front cross brace. The side frames are advantageously pivotable from an extended or unfolded position, to a collapsed or folded position in which the side frames are folded against and roughly parallel to the cross brace. In this manner, the apparatus can be easily folded for ease of transport and storage during periods of non-use. The present invention also provides a sturdy and stable apparatus which may be positioned in either a horizontal or a vertical orientation to permit a wide variety of exercises.

In accordance with a preferred embodiment of the present invention, a foldable exercise apparatus which may be pivotally collapsed is provided. When folded, the apparatus may be stored or transported using a minimum of space; when extended, the apparatus may be used for exercise on almost any flat surface, indoors or outdoors. The apparatus is most preferably capable of being oriented either horizontally or vertically, thereby permitting the user to perform numerous exercises, including dips, push-ups and leg or knee raises, and variations thereof. Preferably, the apparatus when placed in its vertical orientation is supported by at least four vertical support legs, two legs extending downward from each side frame.

In one aspect of this embodiment, the apparatus is pivotally foldable by use of a hinge connected to each side frame which may further be locked in an extended position, thereby providing stability during use. Preferably, this locking is provided by a locking pin or similar means which may be inserted through a hole in a hinge plate into a corresponding receiving hole provided in the cross brace.

In another aspect of this embodiment, the apparatus is constructed of square steel tubing with brace supports, thereby providing sturdy construction. Preferably, the tubing comprising the apparatus frame is welded for strength and durability.

In a further aspect of this embodiment, multiple handgrips are placed at various locations on the apparatus for proper positioning of the user's hands and to provide comfort during exercise. Moreover, using grips to do pushups, as opposed to doing pushups with the hands flat on the ground, advantageously reduces wrist strain and risk of wrist injury. Preferably, the handgrips are made from foam rubber or other suitable material which provides cushioning and a non-slip surface.

In yet another aspect of this embodiment, elastomeric footpads or cups are provided at the bottom ends of the vertical support legs when the apparatus is in its vertical orientation, so as to prevent sliding of the apparatus along the floor during use.

Thus, it is an object of the present invention to provide a new and improved portable, foldable apparatus suitable for positioning in different orientations relative to the user, so as to facilitate a wide variety of upper-body and abdominal exercises, including dips, push-ups and leg or knee raises.

Other related objects will be apparent from the following drawings and description of a preferred embodiment of the invention, and the claims appended thereto.

BRIEF DESCRIPTION OF THE DRAWINGS

FIG. 4 is a rear perspective view illustrating use of the embodiment of FIG. 1 in its vertical orientation for performing traditional or regular dips;

FIG. 5 is a rear perspective view illustrating use of the embodiment of FIG. 1 in its vertical orientation for performing straight leg raises;

FIGS. 5*a* and 5*b* are front perspective views showing a similar use for knee raises;

FIG. 6 is a side perspective view illustrating use of the embodiment of FIG. 1 in its horizontal orientation for performing traditional or regular push-ups;

FIG. 10B is a side view thereof;

FIG. 11 is a top perspective view of the pivot arm shown in FIG. 8;

FIGS. 15–26 show the apparatus of FIG. 8 in use;

DETAILED DESCRIPTION OF THE PREFERRED EMBODIMENTS

Figure 1:
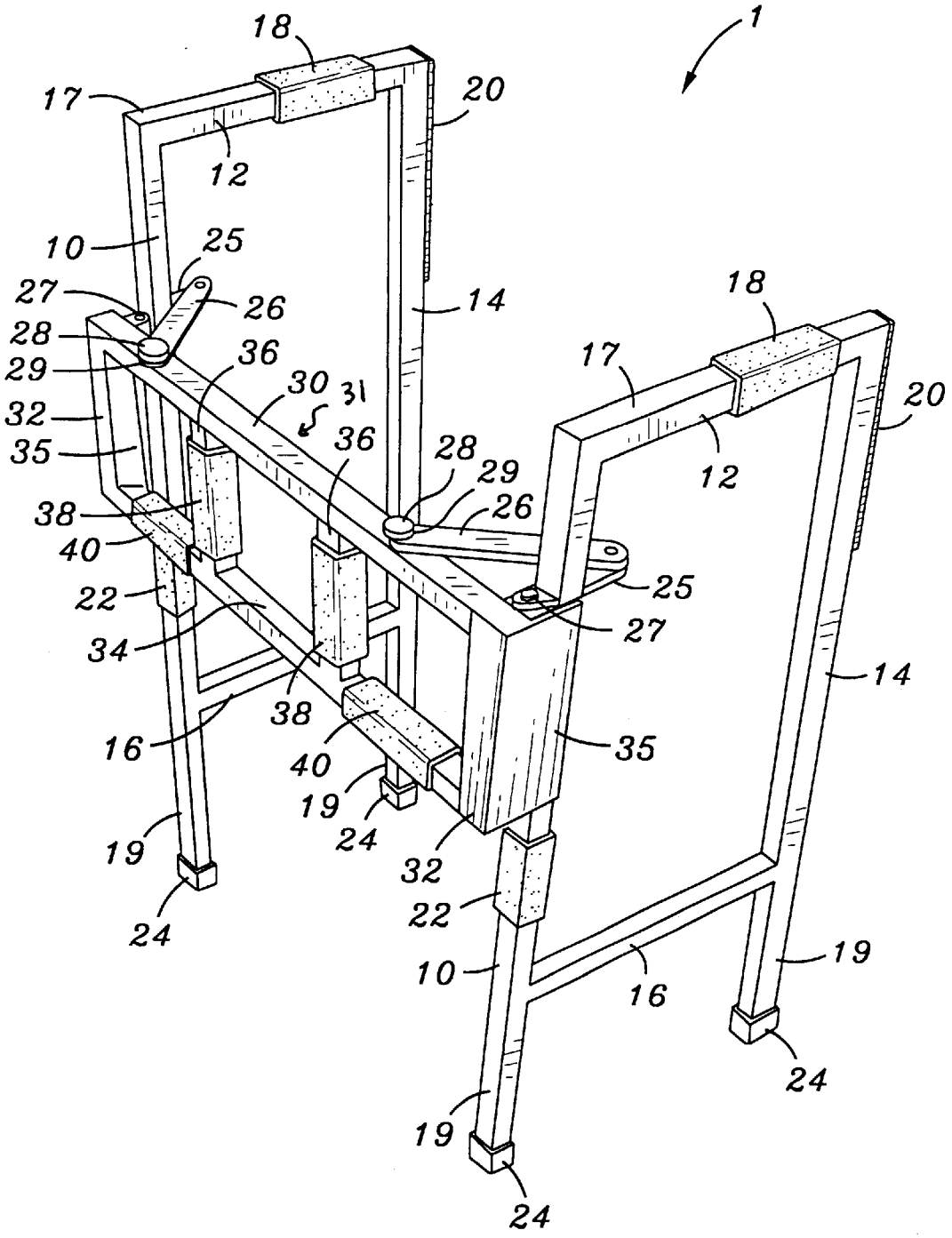
FIG. 1 is a front perspective view of an extended (unfolded) exercise apparatus in a vertical orientation, according to one embodiment of the present invention.

With reference now to the drawings in which like reference numerals are used for like or similar parts throughout the several views, there is shown in FIG. 1 a front perspective view of one embodiment of an exercise apparatus, generally designated by the reference numeral 1, in accordance with the present invention.

In FIG. 1, the exercise apparatus 1 has a pair of side frames 17 pivotally connected to a front cross brace 31 which bridges the side frames. Each of the side frames 17 has a generally rectangular configuration, illustrated in FIG. 1 as defined by a front vertical support 10 and a rear vertical support 14 in a generally parallel coextensive relationship relative to one another, and a top horizontal brace support 12 and a bottom horizontal brace support 16 fixedly and orthogonally mounted to vertical supports 10 and 14. The bottom brace supports 16 are preferably a larger size (1½ "as opposed to 1" for the other sections), and welded into place. The top horizontal brace support 12 on each of the side frames preferably is made of a thicker wall tubing, for added reinforcement.

The side frames 17 and the front cross brace 31 are preferably made from metal tubing, although solid metal rods, as well as other suitable materials such as plastic or fiberglass, may be substituted. It is preferred that the metal tubing be square steel tubing for rigidity and strength, although other suitably rigid metals such as aluminum and other tubing shapes may be used. It is particularly preferred that joints in the metal tubing be welded for durability, although other methods of attachment such as gluing or bolting may be used. It is also contemplated within the scope of the present invention that supports 10, 12 and 14 may consist of a unitary, generally U-shaped tube or rod, bridged by bottom horizontal brace support 16.

When positioned in a vertical orientation, the side frames 17 may optionally have, as shown in FIG. 1, vertical support legs 19 extending downward from each of the vertical supports 10 and 14. The vertical support legs 19 generally provide more stable support for the apparatus on uneven or non-flat surfaces than horizontal brace support 16. The support legs 19 may consist of separate extensions which are, for example, welded onto vertical supports 10 and 14, or may simply be made by using longer vertical supports 10 and 14 that extend downward beyond horizontal brace support 16.

Preferably, the vertical support legs 19 have at their bottom ends footpads 24 to provide frictional engagement of the support legs 19 with a supportive surface contacted by the footpads 24, so as to prevent or minimize sliding of the apparatus 1 across a floor during use. The footpads 24 are preferably made of rubber, although other suitable elastomeric and like materials may be used. The footpads 24 may be simply friction-fitted over the ends of vertical support legs 19. Optionally, however, the footpads 24 may be attached to the end of support legs 19 by threaded rods or screws, or other equivalent means, as to allow vertical adjustment of individual legs to provide stable support on uneven surfaces.

The front cross brace 31 is pivotally connected to side frames 17 such that the side frames when extended are transverse to and project rearward from the cross brace. The side frames 17, when fully extended, are approximately perpendicular to the cross brace 31. In the embodiment illustrated in FIG. 1, the cross brace 31 is generally rectangular in configuration and consists of top horizontal cross support 30, bottom horizontal cross support 34, and a pair of vertical cross supports 32. Preferably, the front cross brace 31 also has a pair of medial cross supports 36 which bridge horizontal cross supports 30 and 34. Attached or affixed to the sideward faces of vertical cross supports 32 are side plates 35 which extend rearward approximately orthogonal to the plane defined by cross brace 31. The side plates 35 prevent side frames 17 from pivoting significantly beyond an orthogonal position relative to the cross brace 31 when the side frames are extended for use. The side plates 35 provide lateral stability and also help to prevent accidental pinching by covering the hinge areas.

In the embodiment illustrated in FIG. 1, each of the side frames 17 is pivoted about a pivot point 27 to which is attached a hinge member consisting of hinge plates 25 and 26. Each of hinge plates 26 has near its distal end a through-hole 29 which may be aligned, when the apparatus is extended, with a receiving hole 33 (shown in FIG. 7) which is located on the top face of horizontal cross support 30. Upon unfolding of the apparatus to its extended position, locking pin 28 may be inserted through through-hole 29 and into receiving hole 33 to lockingly engage the side frames in their extended position. Insertion of the locking pin 28 prevents inadvertent folding or collapse of the side frames 17 during use and provides a stable and sturdy apparatus for exercise. Removal of the locking pins 28 permits folding of the apparatus for storage or transport. Although the embodiment in FIG. 1 illustrates a hinge pivot, other suitable pivot designs may be utilized.

Figure 7:
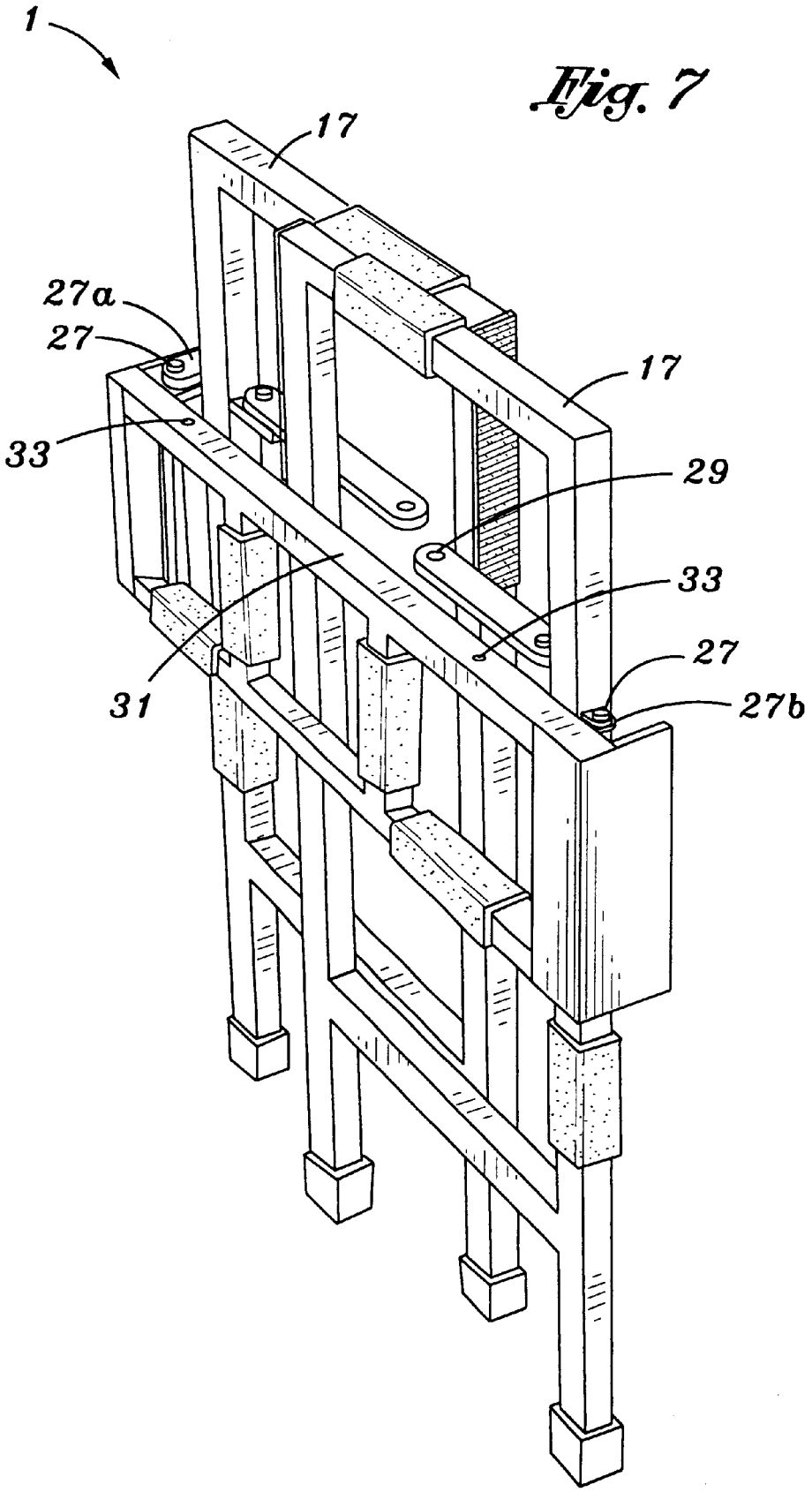
FIG. 7 is a front perspective view of the embodiment of FIG. 1 shown in a folded state for storage or transportation during periods of non-use.

As shown in FIGS. 1 and 7, to allow the side frames to fold flat against each other, the right side pivot point 27 is located behind the left side pivot point by an amount approximately equal to the width of the vertical support 10. This is achieved by making the right side pivot tabs or arms 27*a* longer than the left side pivot tabs or arms 27*b*, as best shown in FIG. 7.

The top horizontal supports 12 include a pair of handgrips 18 or similar means which may be grasped by the user during exercise. In similar fashion, front vertical supports 10 includes handgrips 22 or similar means, bottom horizontal cross support 34 includes handgrips 40 and medial cross supports 36 includes handgrips 38. In each instance, the handgrips are located on the apparatus 1 so as to provide proper hand positioning by the user while performing the various exercises permitted by the apparatus. Appropriate hand positions for each of the exercises is illustrated in FIGS. 2 through 6, which are more fully described below. The handgrips preferably provide a non-slip grip and cushioning for the user's comfort. Moreover, using grips to do pushups, as opposed to doing pushups with the hands flat on the ground, advantageously reduces wrist strain and risk of wrist injury. Suitable materials for the handgrips include rubber, urethane and other foams, and similar materials. The handgrips are attached using known techniques.

Figure 2:
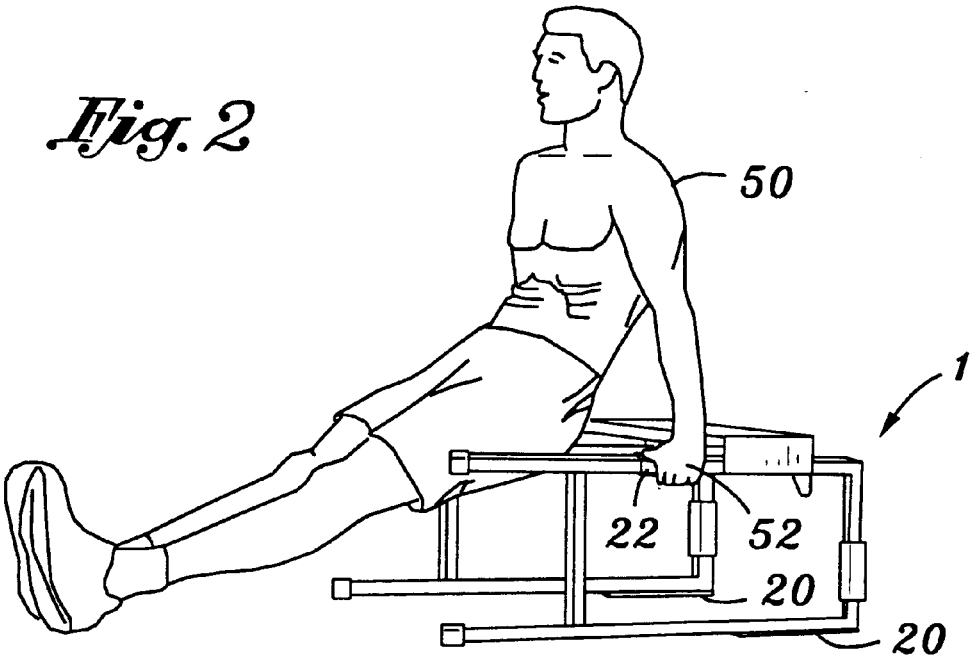
FIG. 2 is a side perspective view illustrating use of the embodiment of FIG. 1 in a horizontal orientation for performing one variation of dips known as seated dips.
Figure 3:
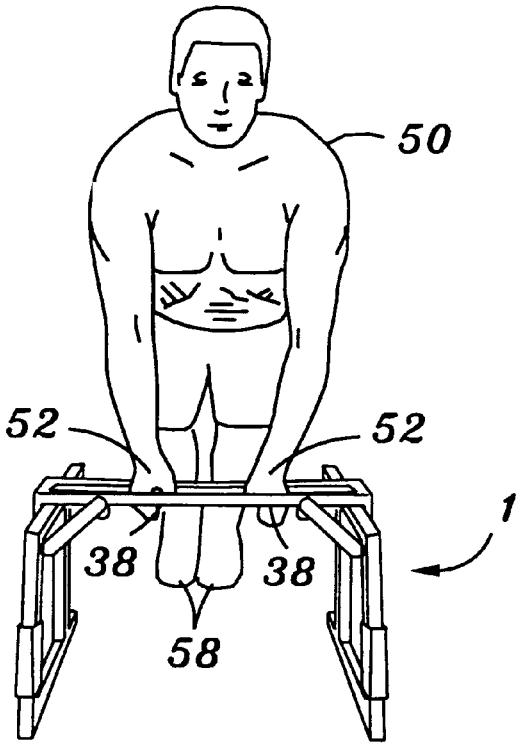
FIG. 3 is a top perspective view illustrating use of the embodiment of FIG. 1 in its horizontal orientation for performing one variation of push-ups known as close parallel-grip push-ups.

Optionally, rubber or other non-slip strips 20 are affixed proximal the top ends of the rear faces of rear vertical supports 14 so as to prevent or minimize sliding of the apparatus 1 during use in its horizontal orientation. In the horizontal orientation, the non-slip strip 20 makes contact with the floor or other supporting surface. The non-slip strip 20 also helps to protect the apparatus surface finish and to prevent scratching or scuffing of the supporting surface during use. Exercises which may be performed using the apparatus in its horizontal orientation are illustrated in FIGS. 2, 3 and 6, which are more fully described below. The apparatus is preferably finished with a textured powder coating (as opposed to an anodized finish).

Referring now to FIG. 2, the apparatus 1 may be positioned in a horizontal orientation to facilitate certain isometric exercises. In the horizontal orientation, non-slip strips 20 provide stable contact of the apparatus with the supporting surface. In FIG. 2, a person 50 is illustrated performing one variation of a tricep dip exercise known as "seated dips." These "seated dips" are similar to regular dips but are made easier by offsetting body weight via having the feet on the ground. In this exercise, the person's hands 52 grasp handgrips 22 for support. In performing seated dips, the person 50 raises and lowers (dips) his or her body about a pivot point defined by the person's heels 56. Tricep dips target development of the tricep and pectoral muscle groups.

Figure 2A:
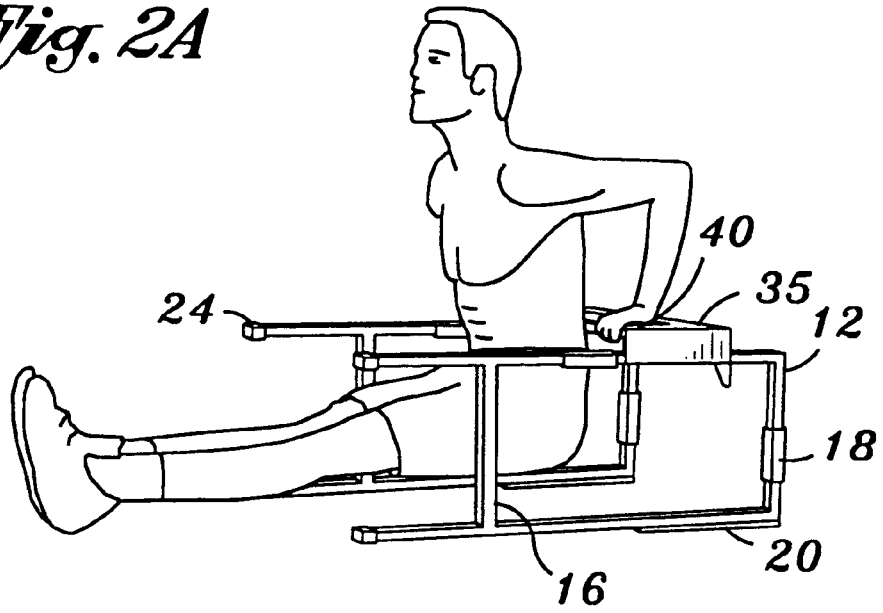
FIGS. 2*a* and 2*b* are front perspective views showing a similar use for tricep dips.
Figure 2B:
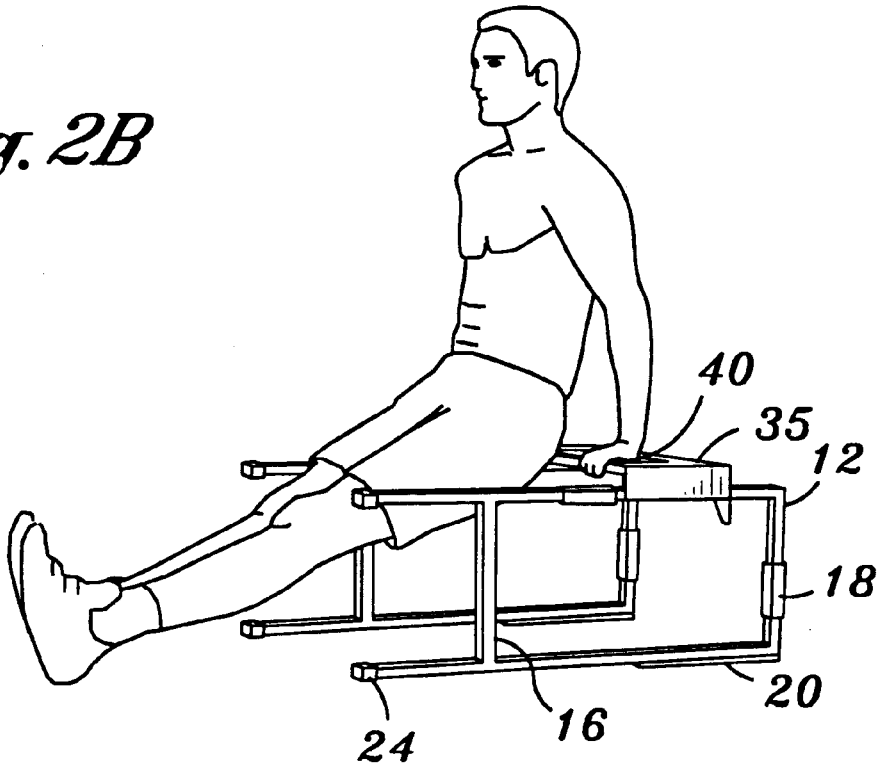

Traditional (or rear) tricep dips, in which the user's hands are placed behind the back, may be performed by simply grasping instead handgrips 40 which are located on cross brace 31 (see FIG. 1). Traditional tricep dips are performed in the same general fashion as "seated dips" but more effectively isolate and target the tricep muscles. As shown in FIGS. 2*a* and 2*b*, the user's hands may also grasp the grips 40, thereby positioning the user's hands behind the users back, to perform traditional tricep dips in a similar manner.

Figure 3A:
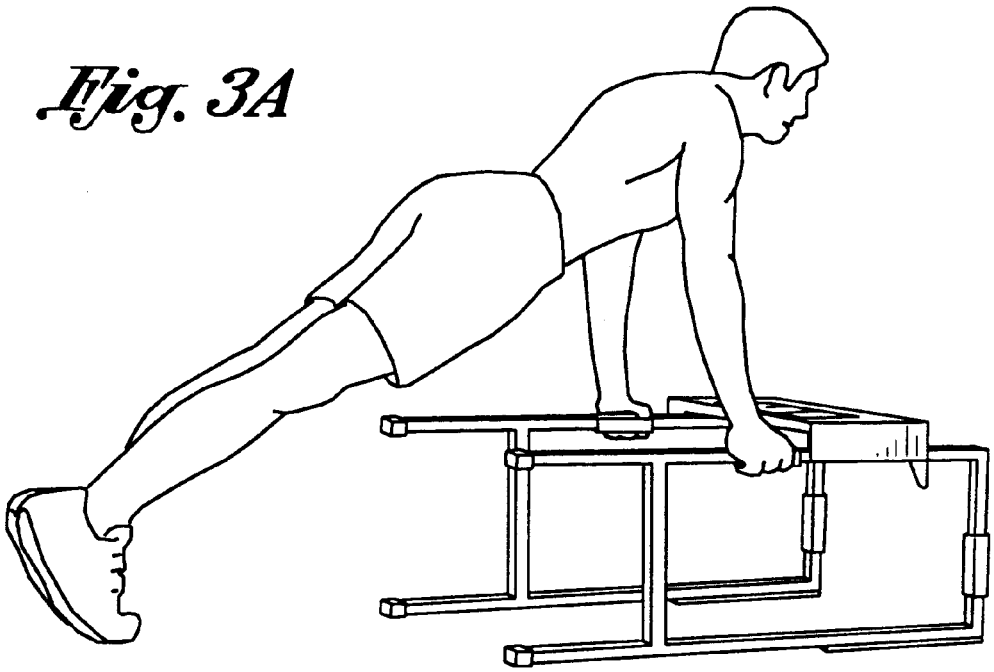
FIGS. 3*a* and 3*b* are side perspective views showing a similar use for wide parallel grip push-ups.
Figure 3B:
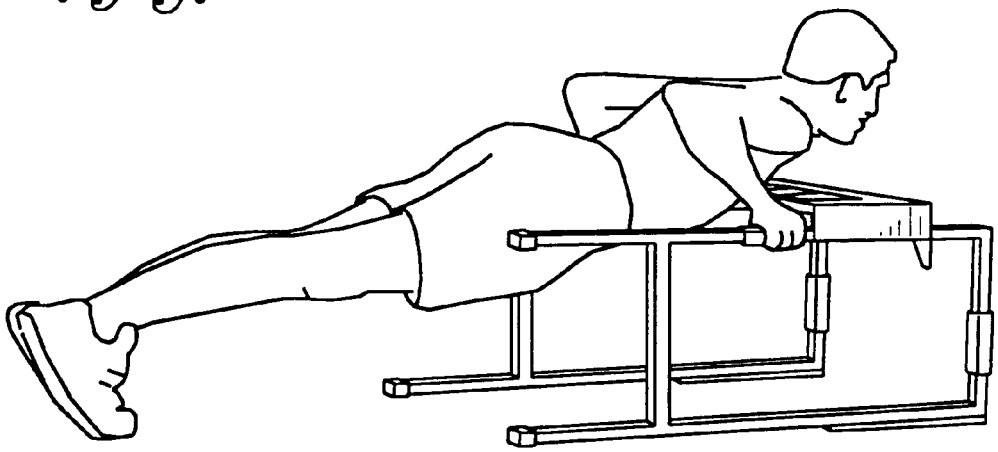

Referring now to FIG. 3, there is shown a person 50 performing one variation of push-ups known as close parallel grip push-ups using the exercise apparatus 1. While grasping handgrips 38 with his or her hands 52, the person 50 raises and lowers his or her body about a pivot point defined by the person's toes 58. This exercise works and develops the triceps, the middle pectorals and the deltoids. Wide parallel grip push-ups, as shown in FIGS. 3*a* and 3*b*, work the outer pectorals, as well as the front deltoids and triceps, and are performed by using handgrips 22 (see FIG. 1). Traditional or regular push-ups may be performed by using instead handgrips 40, and are illustrated in FIG. 6 described below.

Referring now to FIG. 4, there is shown a person 50 performing traditional or regular full-body dips using the exercise apparatus 1 in its vertical orientation. While grasping handgrips 18 with his or her hands 52, the person 50 raises and lowers his or her (preferably entire) body weight by maintaining knees 59 in a bent position so as to keep feet 60 from touching or making contact with the floor or other supporting surface. Regular dips work and develop the tricep and pectoral muscle groups and, secondarily, lats.

Referring now to FIG. 5, there is shown a person 50 performing straight leg raises. In this exercise, handgrips 18 are grasped while facing away from the cross brace, and the person 50 lifts his or legs until approximately orthogonal to his or her torso while maintaining knees 59 substantially extended throughout the leg raise. The straight leg raise works and develops the abdominal muscles. A variation, knee raises, as shown in FIGS. 5*a* and 5*b* may be performed by raising the legs while keeping knees 59 bent. Knee raises work and develop the lower abdominal muscles and hip flexors, and are easier to perform than straight leg raises.

Referring now to FIG. 6, there is shown a person 50 performing traditional or regular push-ups by placement of the hands 52 on handgrips 40. Traditional push-ups provide development of the entire pectorals and also target the front deltoids and the triceps.

While FIGS. 2 through 6 illustrate certain common exercises, it will be understood that variations and combinations of these exercises are also contemplated. In addition, these exercises may be performed with supplemental weights, e.g., ankle weights or belt weights.

Referring now to FIG. 7, there is illustrated the exercise apparatus 1 in a folded or collapsed state. To permit folding of the apparatus, locking pin 28 (not shown) has been removed from receiving hole 33 and through-hole 29. After removal of the locking pin, side frames 17 are pivoted about pivot points 27 until the side frames 17 are folded against and roughly parallel to cross brace 31. The locking pin 28 can be stored in the receiving hole 33. When folded the apparatus may easily be stored or transported.

The apparatus 1 is preferably made of welded steel tube construction. This design provides sufficient rigidity for the apparatus to reliably be used to perform exercises which generate substantial loads on the apparatus, without significant bending, wobbling, or deflection. The parallel alignment of the front and rear vertical supports 10 and 14 provides the preferred geometry for the handgrips when the apparatus 1 is in the prone position as shown for example in FIG. 2. Referring to FIGS. 5*a* and 7, as the apparatus 1 rises only to about the users hip region, and because the apparatus is readily folded, it can easily fit into the trunk of a car, into a closet, behind a door, or under a bed.

Turning to FIGS. 8–11, a second embodiment 100 has a pair of side frames 117 pivotably attached to a cross brace 131. Each side frame 117 has a front vertical support 110 having a handle bar 112. A rear support 114 extends outwardly and downwardly from a middle position of the front vertical support 110. A horizontal brace 116 extends from a lower position of the front vertical support 110 to a lower and rear position on the rear support 114. Footpads 124 are attached to the bottom ends of the front vertical support 110 and rear support 114. Each rear support 114 has a horizontal section 161 adjoining the front vertical support 110, an angled section 162, extending downwardly at an angle from the horizontal section 161, and adjoining a vertical section 163.

Figure 8:
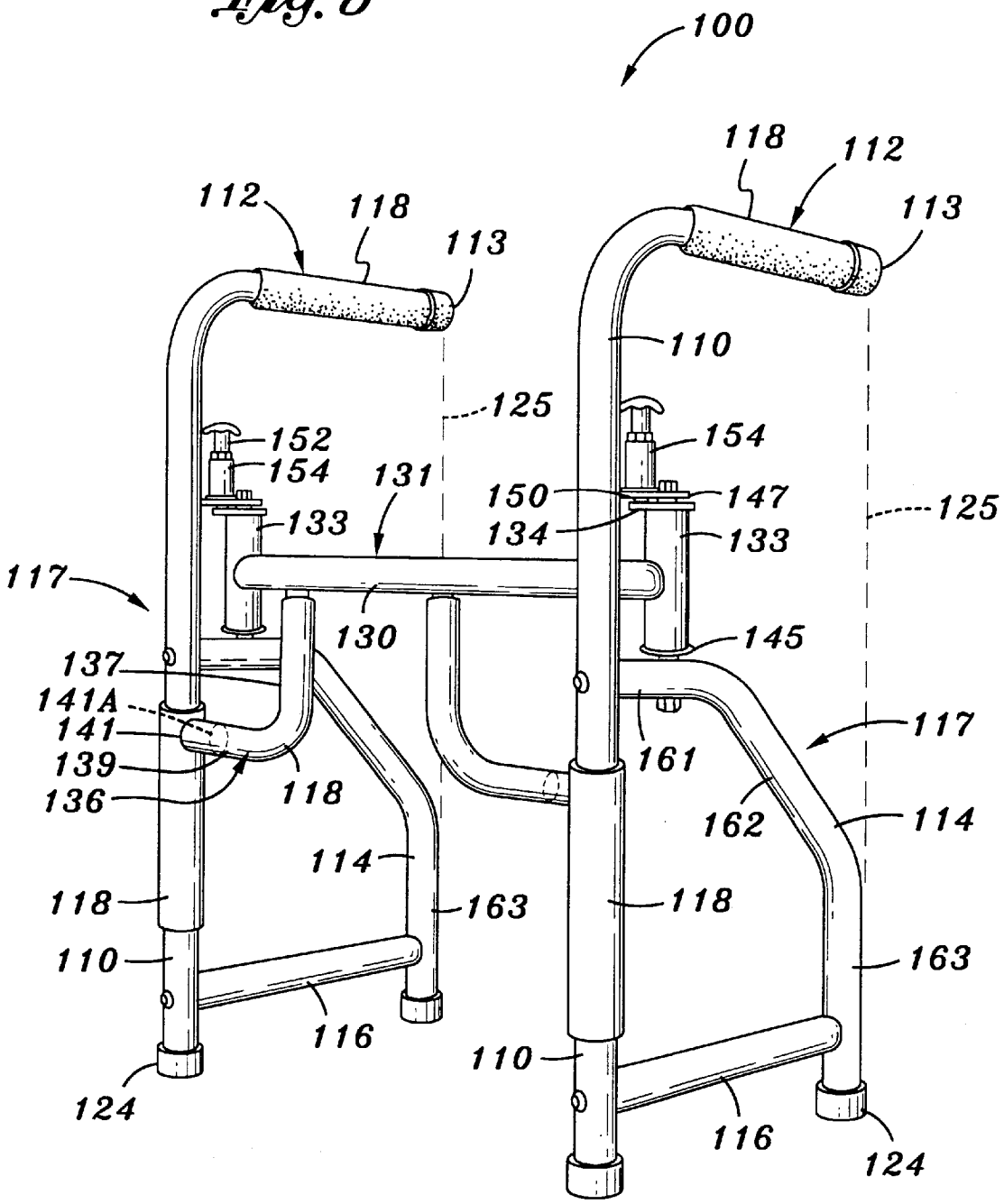
FIG. 8 is a front perspective view of a second embodiment in the unfolded or erected position.
Figure 9:
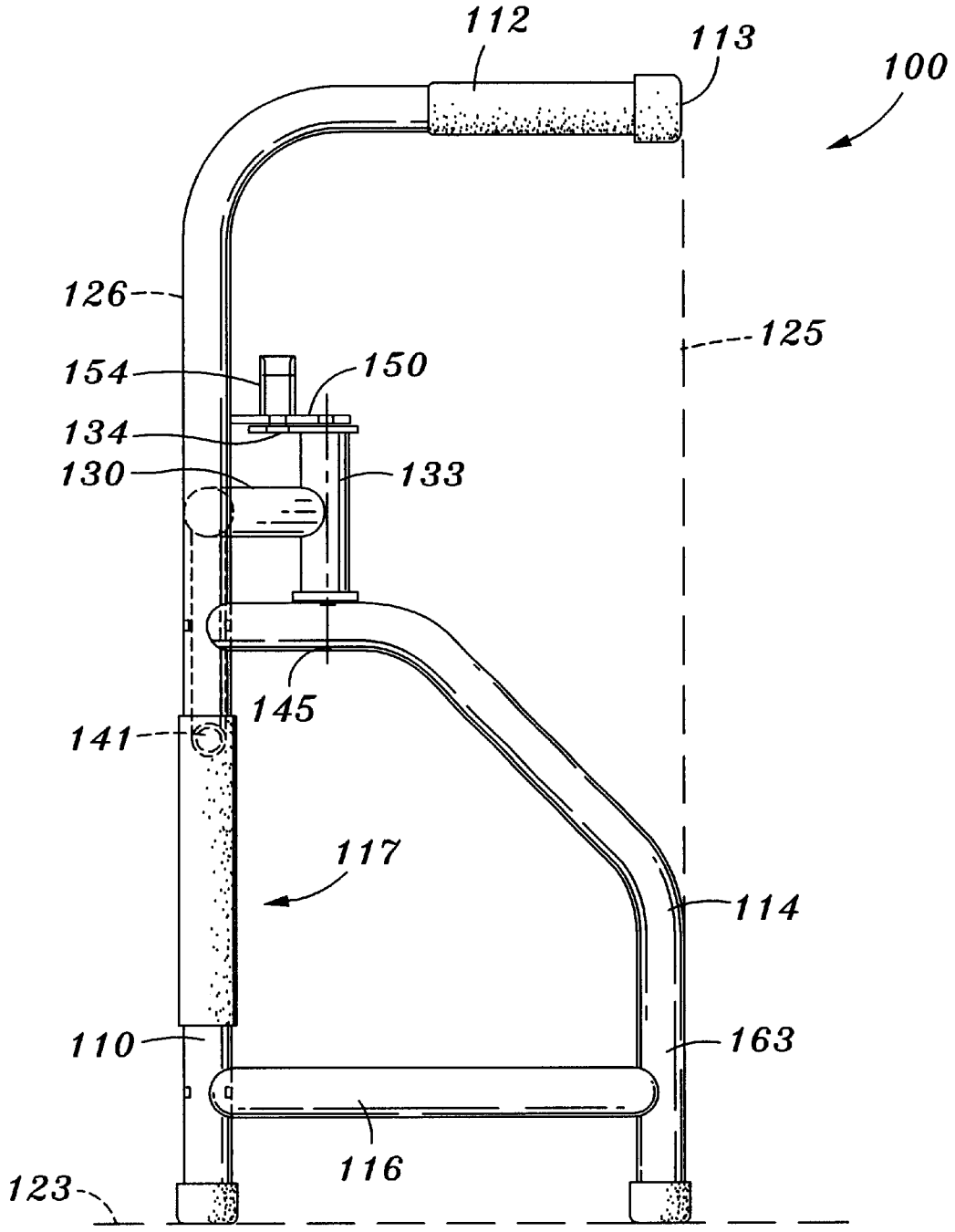
FIG. 9 is a side elevation view thereof.

Referring to FIGS. 8 and 9, the back ends 113 of the handle bars 112 are preferably co-planer with the back surface of the vertical section 163 of the rear support 114, thereby defining a back plane 125, on which the apparatus 100 can rest.

Similarly, the footpads 124, or the bottom ends of the front vertical supports 110 and vertical sections 163 of the rear supports 114 are coplanar, and define a foot plane 123. The handle bar 112 is preferably parallel to the horizontal brace 116 and the foot plane 123. The handle bar 113 is also preferably perpendicular to the vertical section 163 and back plane 125. The front surface of the front vertical supports 110 forms a front plane 126, parallel to the back plane 125, and perpendicular to the foot plane 123.

Figure 12:
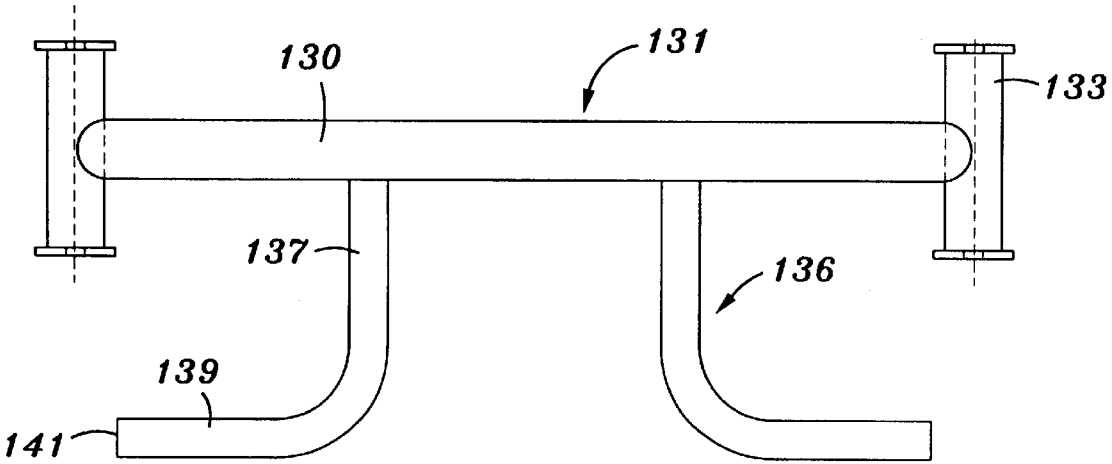
FIG. 12 is a front view of the cross support shown in FIG. 8.

Referring to FIGS. 8 and 12–14, the cross brace 131 includes a horizontal cross support 130 having end tubes 133 attached at its ends. Right angle mid-bars 136 are attached to and extend down from the cross support 130. The mid-bars 136 each have a vertical or first mid-bar section 137 and a second or horizontal mid-bar section 139 extending at right angles to the first mid-bar section 137. The mid-bars 136 are equally spaced apart from the end tubes 133, as shown in FIG. 12.

The ends 141 of the horizontal mid-bar sections 139 are dimensioned so that, as shown in FIG. 8, with the apparatus 100 in the unfolded or erected condition, the mid-bar ends 141 touch the front vertical supports 110, or handgrips 118 provided on the front vertical supports 110.

Referring to FIGS. 8 and 11, a pivot arm 150 is attached to each front vertical support 110. A pivot pin 155 extends through the pivot arm 150, to form an upper pivot joint 147 between the pivot arm 150 and the end tube 133, on each of the side frames 117. The pivot pin 155 extends through the end tube 133, and through the vertical section 163 of the rear support 114 on each side frame 117, to form a lower pivot joint 145, between each side frame 117 and the cross brace 131.

As shown in FIG. 11, a quick release lock pin 152 extends through a pin holder 154 and into a first (open position) hole (not shown) on a tube arm 156 attached on top of the end tube 133. The pin 152 is spring biased downwardly into the tube arm 156. A folded or closed position hole 158 extends through the tube arm 156 on the same radius from the pivot pin 155 as the first hole.

Handgrips 118 formed of rubber or other cushioning material, are attached to the handle bars 112, mid-bars 136, and to the lower section of the front vertical supports 110, as shown in FIG. 8.

Figure 15:
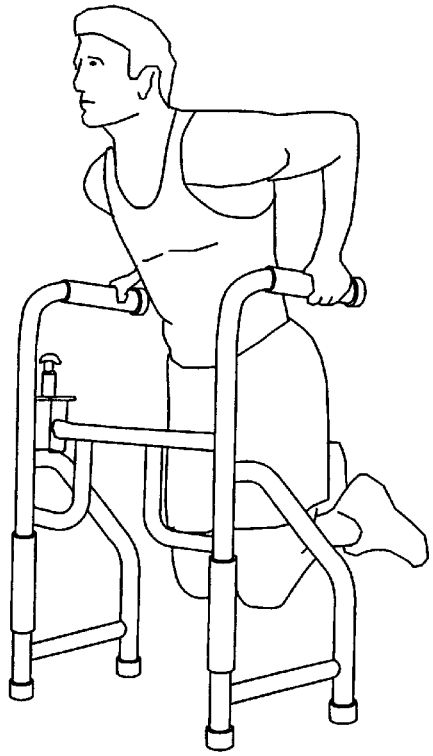
Figure 16:
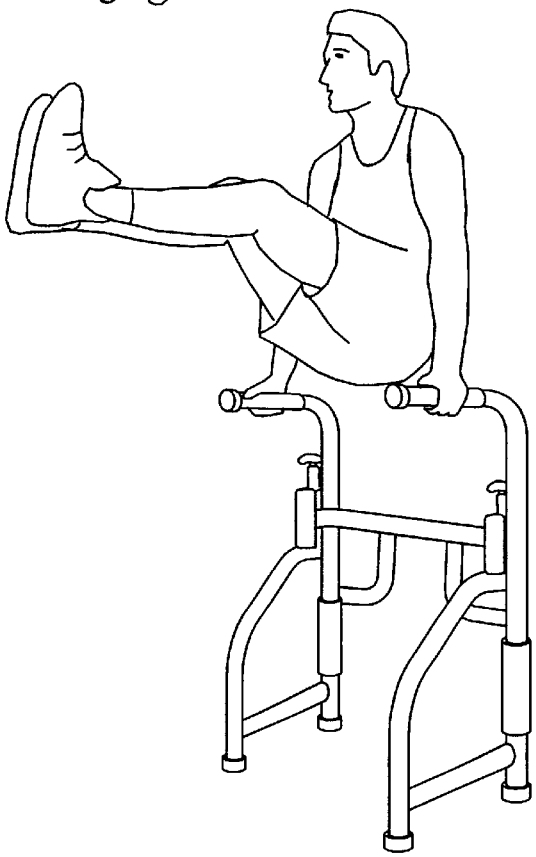
Figure 17:
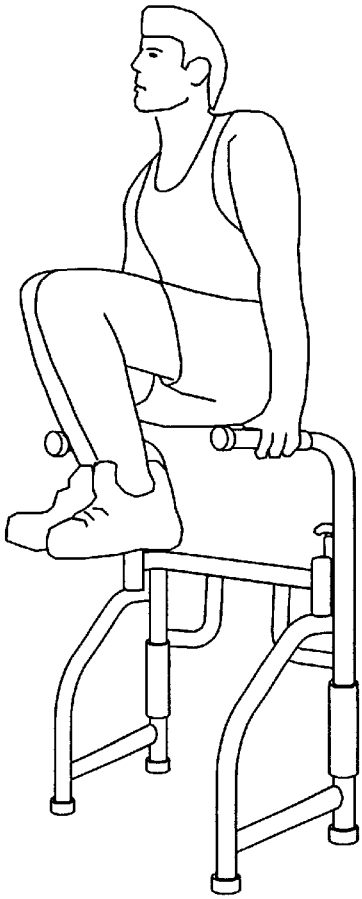

In use, the apparatus 100 operates in a manner similar to the first embodiment 1, as shown in FIGS. 1–7. As shown in FIG. 8, with the apparatus 100 in the unfolded or erected and vertically upright position, the apparatus 100 is useful for performing traditional or regular dips, as shown in FIG. 15; for performing straight leg raises, as shown in FIG. 16; or for use in performing knee raises, as shown in FIG. 17, with the users hands on the handlebars 112.

Figure 18:
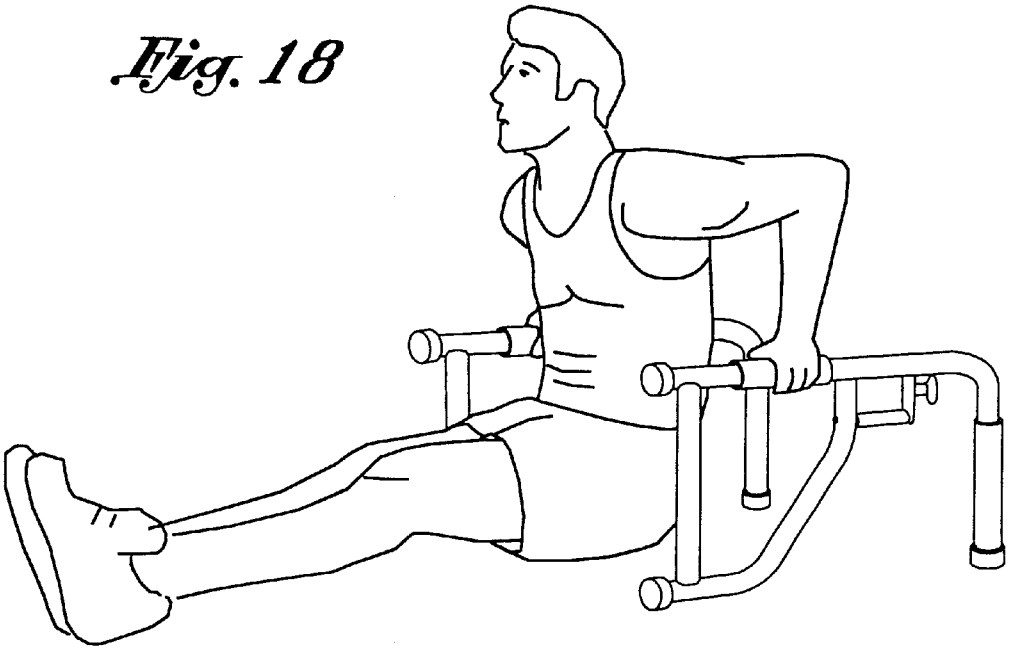
Figure 19:
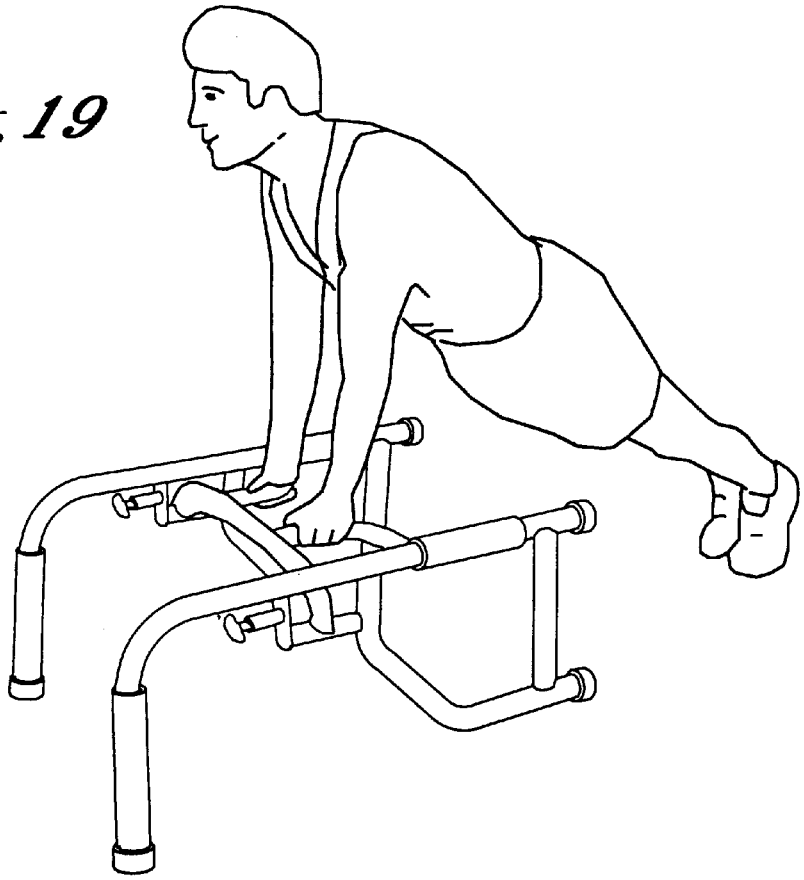
Figure 20:
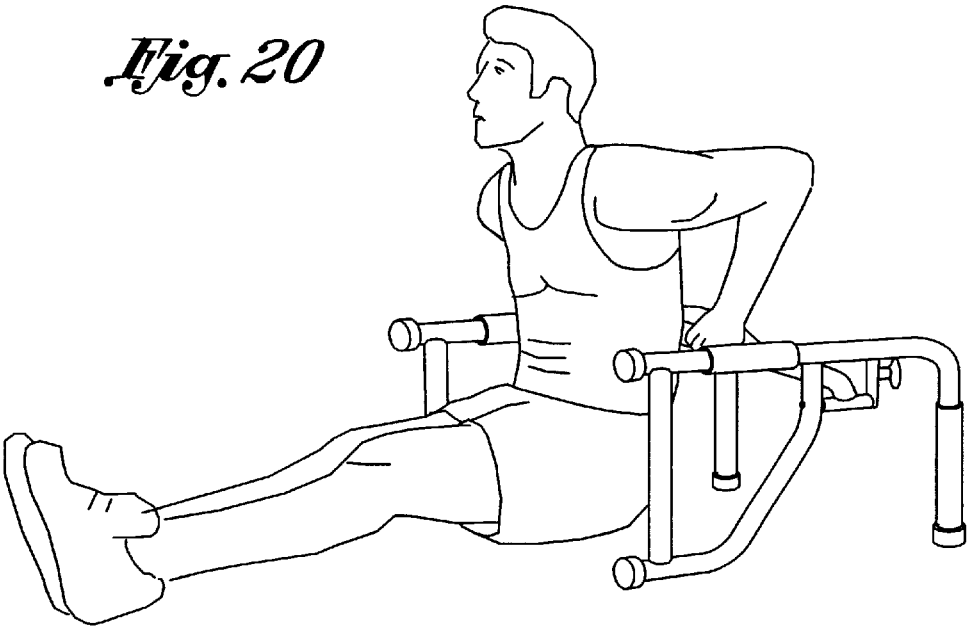
Figure 21:
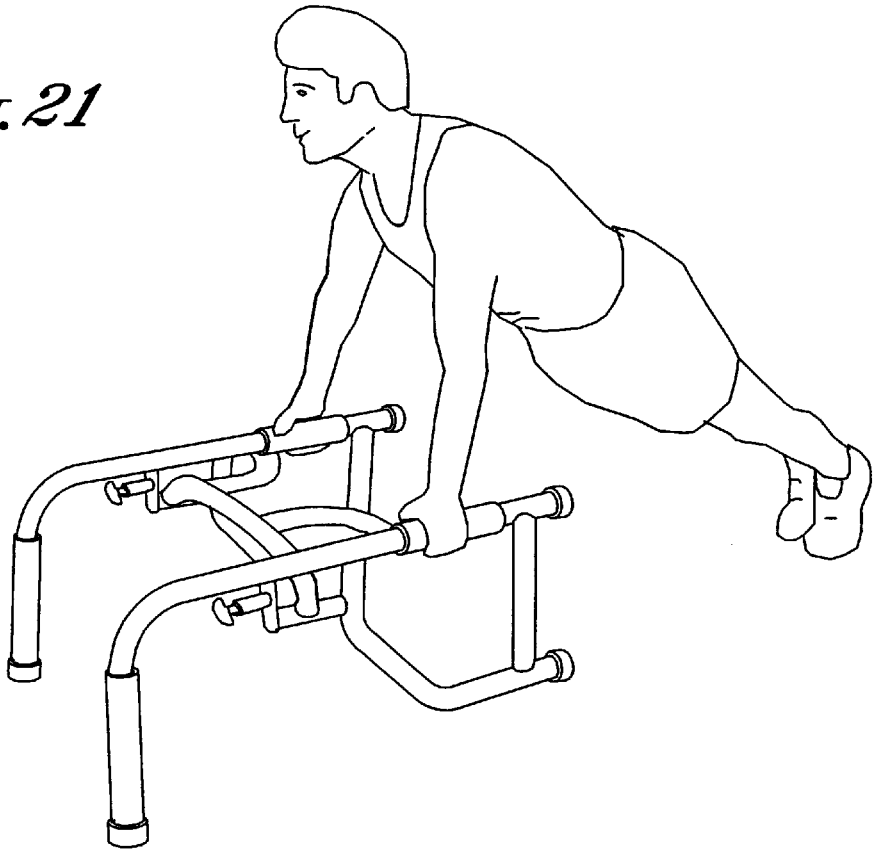
Figure 22:
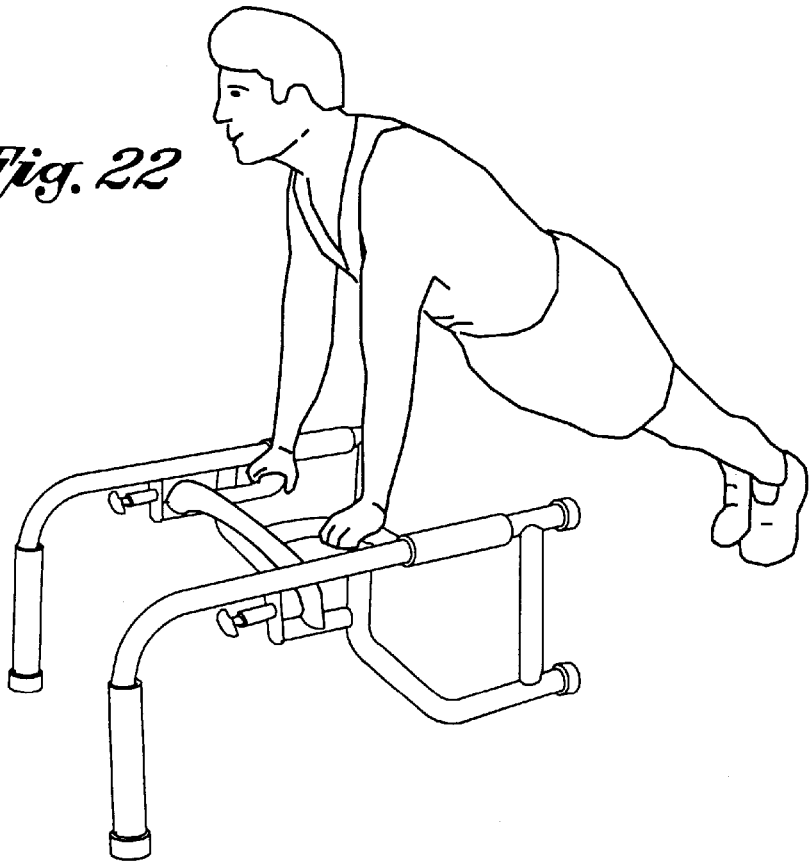
Figure 23:
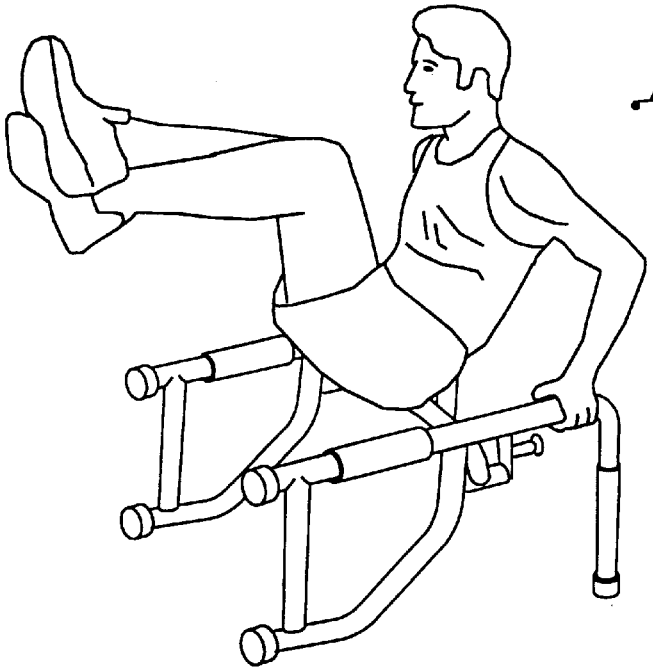

With the apparatus 100 in the unfolded or erected position, and with the back plane 125 supported on the floor, the apparatus 100 is useful for performing a variation of tricep dips known as "seated dips" or "tricep dips," as shown in FIG. 18 with the user's hands on the handgrips 118 on the front vertical supports; for performing a variation of push-ups known as close parallel grip push-ups, as shown in FIG. 19, with the user's hands on the vertical section 137 of the mid bars; for performing back tricep dips, as shown in FIG. 20, with the user's hands on the horizontal sections 139 of the mid-bars 136; for performing wide parallel grip push-ups, with the user's hands on the handgrips 118 on the front vertical supports 110, as shown in FIG. 21; or for performing traditional or regular push-ups, with the user's hands on the horizontal sections 139 of the mid-bars 136, as shown in FIG. 22; or for performing abdominal crunches, with the user's hands on the upper section of the front vertical supports, just below the handle bars, as shown in FIG. 23. When resting between abdominal crunch sets, the user sits on the cross brace 13. The exercising movements shown in FIGS. 15–22 are further illustrated with reference to FIGS. 2*a*, 2*b*, 3*a*, 3*c*, 5*a* and 5*b*.

As shown in FIGS. 24–26, the apparatus 100 can be lifted off of the ground to perform regular curls (as shown in FIG. 24); hammer curls (as shown in FIG. 25); and military presses, as shown in FIG. 26. FIG. 26 shows that the side frames force the user's elbows in which better isolates the muscles used. In addition, with the user's hands on the vertical sections 137, the apparatus is balanced to facilitate military presses, i.e., the center of gravity (vertically) is substantially positioned along a horizontal axis extending through the vertical sections 137.

For storage or transportation, the lock pins 152 are pulled up and out of the holes in the tube arms 156. The side frames 117 are then free to pivot relative to the cross brace 131. The side frames 117 are moved in the direction of the arrow C, as shown in FIG. 11, to the fully folded position shown in FIG. 10. The lock pin 152 may optionally be re-inserted into the folded position hole 158 in each tube arm 156 for locking the side frames 117 into the folded position.

Figure 10A:
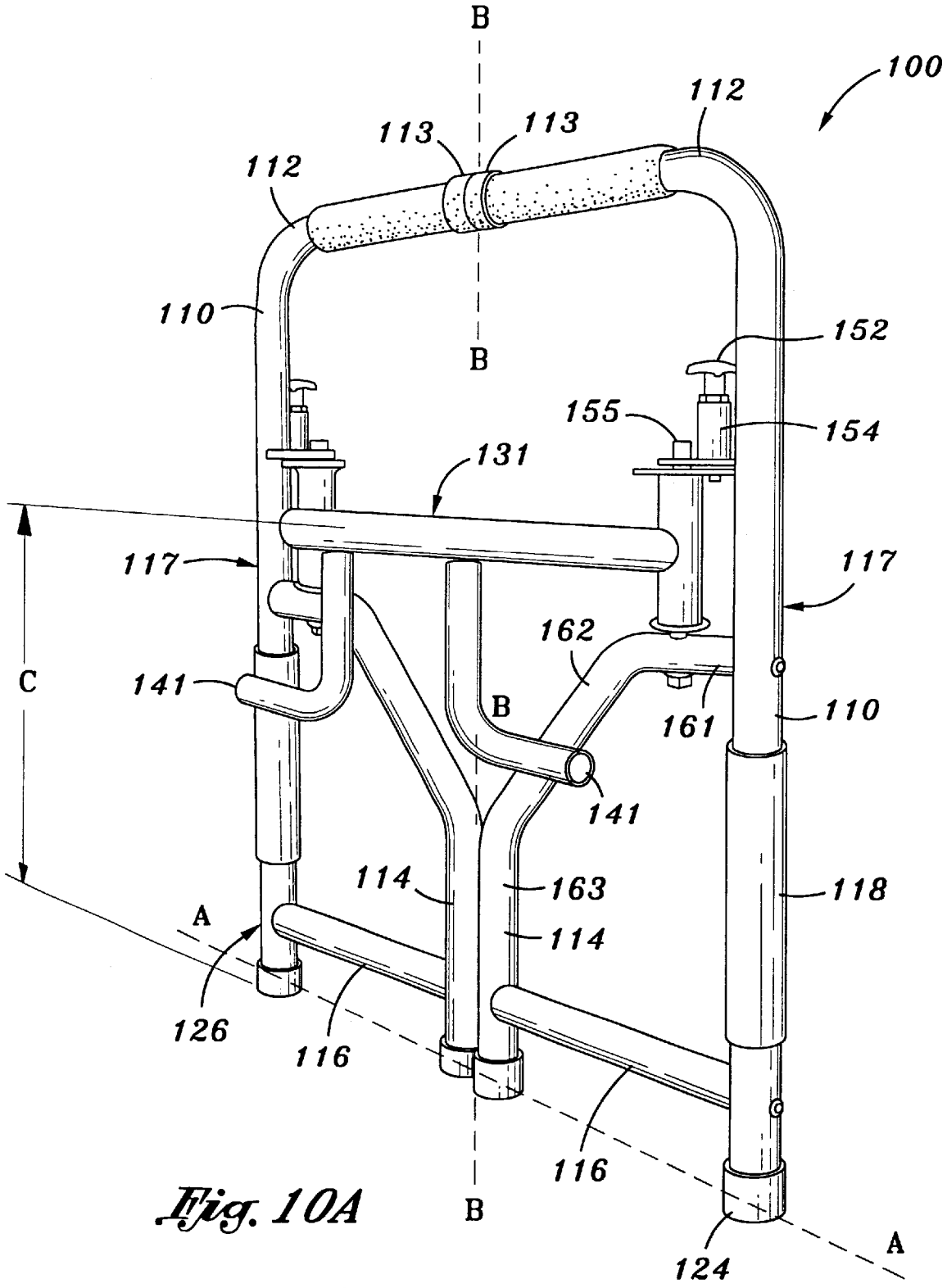
FIG. 10A is a perspective view thereof showing the second embodiment in the folded position for storage or transportation.
Figure 13:
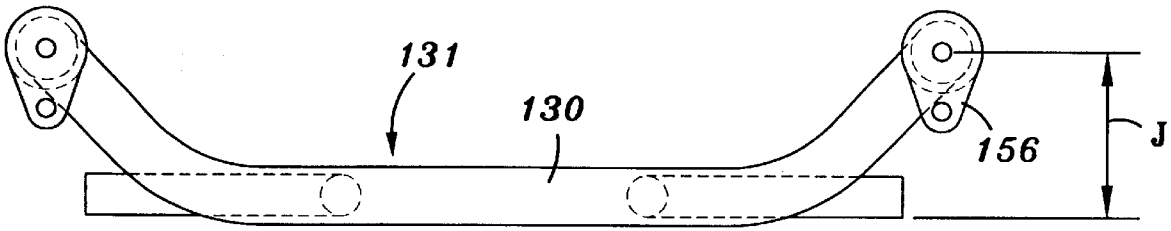
FIG. 13 is a top view thereof.
Figure 14:
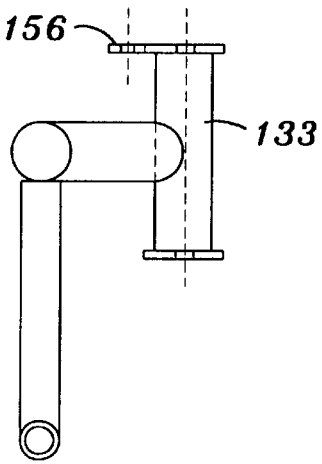
FIG. 14 is a side view thereof.

Referring to FIG. 10A, with the apparatus in the folded position as shown, the handle bar ends 113 are adjacent or touching each other, along Line B—B. Similarly, the vertical sections 163 of the rear supports 114 on each side frame 117 (or the footpads 123 on the vertical sections 163) are adjacent to or touching each other, along Line B—B. As a result, the apparatus 100 is compact when folded. As shown in FIG. 10B, when folded, the side frames lie in a single plane, and the only part of the apparatus 100 projecting out of that plane is the cross brace, which protrudes above the side frames by dimension J in FIG. 13, i.e., from 2–8 inches, and preferably by about 5 inches.

The dimension C from the foot plane 123 to the cross support 130 is dimensioned so that, for most users, the apparatus 100 can be carried by lifting the cross brace 131, and holding the apparatus 100 at the user's side, without the footpads 124 touching the floor, for easy carrying.

In an alternative embodiment, the mid-bar ends 141A are shortened, so that they do not touch the handgrips 118 on the front vertical supports 110, as shown in phantom in FIG. 8.

Figure 27:
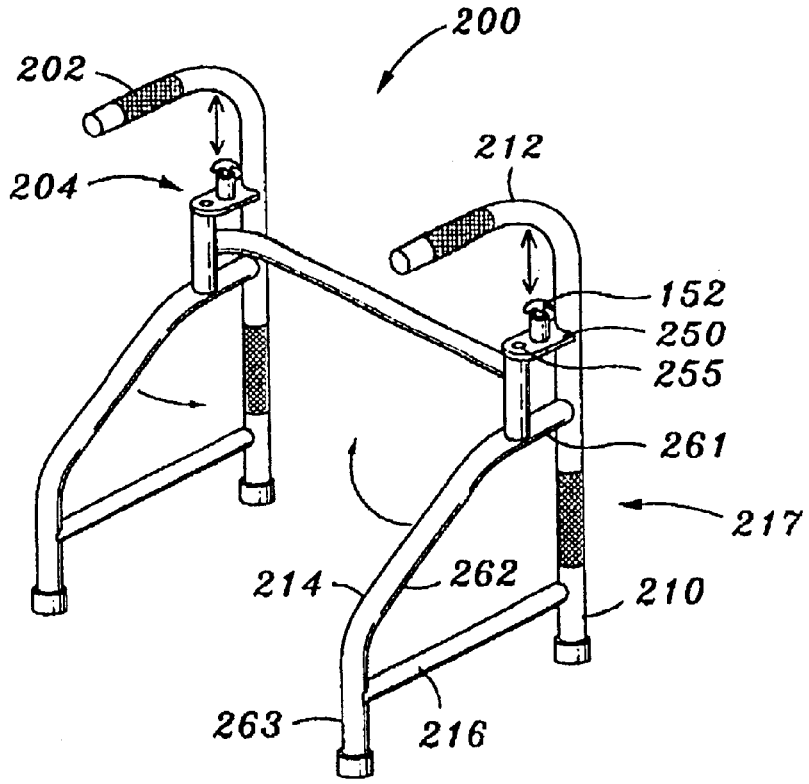
FIG. 27 is a rear perspective view of a third embodiment in the unfolded or erected position.
Figure 28:
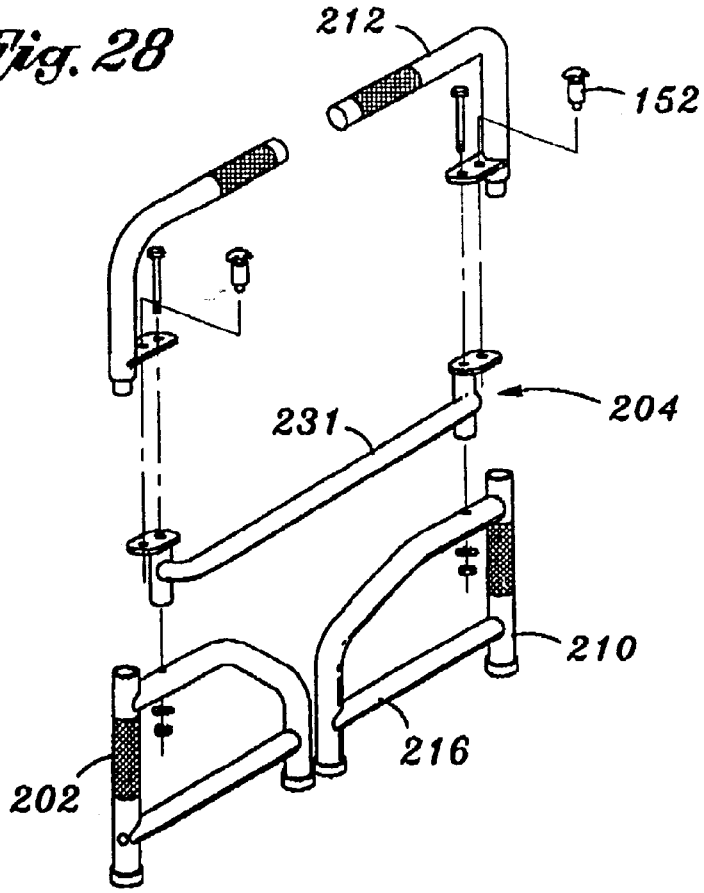
FIG. 28 is a partially exploded rear view thereof in the folded or storage position.

Turning to FIGS. 27 and 28, a third embodiment 200 includes a pair of side frames 217 pivotably attached to a cross brace 231. Each side frame 217 has a front vertical support 210 having a handle bar 212. A rear support 214 extends outwardly and downwardly from a middle position of the front vertical support 210. A horizontal brace 216 extends from a lower position of the front vertical support 210 to a lower and rear position on the rear support 214. Each rear support 214 has a horizontal section 261 adjoining the front vertical support 210, an angled section 262, extending downwardly at an angle from the horizontal section 261, and an adjoining vertical section 263.

Unlike the embodiment 100 shown in FIG. 8, this third embodiment 200 does not include a right angle mid-bars attached to and extending downward from the cross support or cross brace 231. Moreover, in this third embodiment 200, the handgrips or grips 202 are shown as being etched in the handlebars 212 and the lower section of the front vertical support 210. However, it is preferable that the grips be made of a resilient material, such as rubber, urethane and other foams, or the like. The grips 202 of the apparatus 200 advantageously provide a non-slip surface during intense isometric training routines and advantageously reduce wrist strain and risk of wrist injury.

In all other respects, the third embodiment 200 is identical to the embodiments 100 and 200 shown in FIGS. 1–26. For example, the third embodiment 200 is made of welded steel tube construction of sufficient thickness to withstand substantial loads on the apparatus without significant bending, wobbling, or deflection, even under extreme loads generated by heavy users. Not only strong and stable, the third embodiment 200 also includes the advantage of a locking mechanism 204 that can be used to lock the side frames 217 in the folded position, and, optionally, the unfolded position.

As disclosed in conjunction with FIG. 8, the locking mechanism 204 includes a pivot arm 250 attached to each front vertical support 210 and quick release lock pin 252 disposed about each pivot arm 250. A pivot pin 255 extends through the pivot arm 250 on each of the side frames 117 and is spring-biased to maintain the pin in a folded position hole or possibly an unfolded position hole.

The apparatus 200 also includes the pivoting configuration shown in FIG. 8 and discussed above which enables the side frames 217 to lie in a single plane when in the folded position such that no obtrusive protrusions exist during storage or transportation.

Preferably, the apparatus 1, 100, and 200 weighs from 20–50 pounds, and most preferably from 30–40 pounds and nominally 35 pounds. The side frames and cross brace are preferably 0.090 wall steel tubes, 1½ inch O.D.

The apparatus 1, 100, and 200 can be quickly set up to do "supersets." It provides a fast and intense method of training. The user does 2–3 sets back to back before resting. The variations of dips and push ups, and other exercises are beneficial for fast, effective training. Supersets cut out a lot of rest period time, making for fast exercising.

Although particular embodiments of the present invention has been described in the foregoing detailed description, it will be understood by one of ordinary skill in the art that the invention is capable of numerous modifications without departing from the scope of the invention. The invention, therefore, should not be restricted, except by the following claims, and their equivalents.

We claim:

1. An exercise apparatus comprising:

a cross brace;

a first side frame pivotably attached to a first side of the cross brace;

a second side frame pivotably attached to a second side of the cross brace;

the first side frame and the second side frame pivotable with respect to the cross brace to open and closed positions;

means for locking the first side frame and the second side frame into the open position; and wherein the cross brace and the side frames are sufficiently rigid to resist excessive bending or deflection during the performance of an exercise.

2. The exercise apparatus of claim 1 wherein the side frames have a horizontal handle bar cantilevered off of a front vertical support.

3. The exercise apparatus of claim 2 further comprising a grip on the front vertical support of each of the side frames.

4. An exercise apparatus comprising:

a first side frame having a handlebar and a front vertical support;

a second side frame having a handlebar and a front vertical support;

a cross brace having a first end pivotally attached to the first side frame and a second end pivotally attached to the second side frame; and a grip on the front vertical support of each of the side frames.

5. The exercise apparatus of claim 4 further comprising a locking mechanism for locking the side frames into an open position for use.

6. The exercise apparatus of claim 5 wherein the locking mechanism includes a pivot arm attached to each front vertical support and a quick release pin disposed about each pivot arm.

* * * * *